US006823932B2

(12) United States Patent
Birkholz

(10) Patent No.: US 6,823,932 B2
(45) Date of Patent: Nov. 30, 2004

(54) SELF-FIXTURING SIDE PIECE FOR BRAZED HEAT EXCHANGERS

(75) Inventor: Donald F. Birkholz, Kenosha, WI (US)

(73) Assignee: Modine Manufacturing Company, Racine, WI (US)

( * ) Notice: Subject to any disclaimer, the term of this patent is extended or adjusted under 35 U.S.C. 154(b) by 403 days.

(21) Appl. No.: 09/866,188

(22) Filed: May 25, 2001

(65) Prior Publication Data

US 2002/0174975 A1 Nov. 28, 2002

(51) Int. Cl.[7] ..... F28D 1/00

(52) U.S. Cl. ..... 165/149; 165/150; 165/152; 165/181; 165/182; 165/183

(58) Field of Search ..... 165/67, 149, 150, 165/152, 181, 182, 183; 180/68.4

(56) References Cited

U.S. PATENT DOCUMENTS

| | | | | | |
|---|---|---|---|---|---|
| 5,183,103 | A | * | 2/1993 | Tokutake | 165/67 |
| 5,240,068 | A | * | 8/1993 | Tokutake | 165/67 |
| 5,246,064 | A | * | 9/1993 | Hoshino et al. | 165/146 |
| 5,269,373 | A | * | 12/1993 | Sagawa et al. | 165/149 |
| 5,289,872 | A | * | 3/1994 | Kent | 165/133 |
| 5,325,914 | A | * | 7/1994 | Tanaka | 165/67 |
| 5,348,079 | A | * | 9/1994 | Tanaka | 165/67 |
| 5,379,834 | A | * | 1/1995 | Tokutake | 165/178 |
| 5,429,182 | A | * | 7/1995 | Hanafusa | 165/67 |
| 5,441,100 | A | * | 8/1995 | Ueda et al. | 165/67 |
| 5,458,190 | A | * | 10/1995 | Sasaki et al. | 165/110 |
| 5,482,112 | A | * | 1/1996 | Sasaki et al. | 165/110 |
| 5,509,473 | A | * | 4/1996 | Tokutake | 165/178 |
| 5,529,117 | A | * | 6/1996 | Voss et al. | 165/144 |
| 5,570,737 | A | * | 11/1996 | Tokutake | 165/67 |
| 5,628,361 | A | * | 5/1997 | Getto | 165/67 |
| 5,632,332 | A | * | 5/1997 | Hanafusa | 165/178 |
| 5,725,047 | A | * | 3/1998 | Lopez | 165/149 |
| 5,765,284 | A | * | 6/1998 | Ali et al. | 29/890.047 |
| 5,899,263 | A | * | 5/1999 | Tokutake | 165/67 |
| 5,931,220 | A | | 8/1999 | Ueda et al. | |
| 5,975,197 | A | * | 11/1999 | Kado | 165/149 |
| 6,619,386 | B2 | * | 9/2003 | Iino et al. | 165/173 |

FOREIGN PATENT DOCUMENTS

| | | | | |
|---|---|---|---|---|
| JP | 62153691 | | 7/1987 | |
| JP | 404270895 | A * | 9/1992 | F28F/9/00 |
| JP | 11148792 | | 6/1999 | |

* cited by examiner

*Primary Examiner*—Henry Bennett
*Assistant Examiner*—Nihir Patel
(74) *Attorney, Agent, or Firm*—Wood, Phillips, Katz, Clark & Mortimer

(57) ABSTRACT

The added expense of providing fixtures for holding side pieces in heat exchangers in place during assembly is avoided in a heat exchanger having a core with at least one row of spaced, parallel, straight runs (12–20); (70–86) of flattened tubing (10) which includes first and last spaced side runs (12), (20); (70), (92) which define an associated side on opposite sides of the row. Fins (36), (62) bridge the spacing between each of the plurality of runs and extend oppositely from outwardly facing sides (42), (44); of the first and last runs (12), (20); (70), (92); and are bonded to the tubing (10). A pair of side pieces (46), one for each side of the row, are provided and are hooked on the associated ends of the first and last runs (12), (20); (70), (92). The side pieces (46) are self-fixturing by reason of being hooked on the tubing.

11 Claims, 2 Drawing Sheets

SELF-FIXTURING SIDE PIECE FOR BRAZED HEAT EXCHANGERS

FIELD OF THE INVENTION

This invention relates to heat exchangers, and more particularly, to brazed heat exchangers having side pieces.

BACKGROUND OF THE INVENTION

Many heat exchangers today employ several parallel runs of straight tubing of flattened cross section which are spaced from one another. Between the straight runs of tubing, fins exist which may be either plate fins or serpentine fins. The runs define at least one row of tube runs and the first run in the row defines one side and the last run in the row defines the opposite side. Typically, fins will be bonded to both the first and last rows to extend outwardly of the sides of the resulting core. Where the runs are made up of individual pieces of tubing, headers will receive respective ends of each of the individual pieces of tubing. Where the runs are defined by straight lengths of a serpentine wound length of tubing, headers will be placed on one end of both the first and last runs and 180° turns formed in the tubing will interconnect the ends of the intermediate runs. Again, fins will extend between the runs as well as outwardly from opposite sides of the first and last runs.

Side pieces are also typically employed in these constructions. In many instances the side pieces will extend fully between the headers just outwardly of the outermost fins of the first and last runs to provide rigidity to the heat exchanger once it is brazed or otherwise has its components bonded together and serve to protect the fins that are exterior of the tube runs as well as rigidify the heat exchanger. Similar side pieces will be employed in heat exchangers of the serpentine type but obviously cannot extend between the headers because there will be only one header at each of the first and last runs.

In the usual case, such heat exchangers are placed in a fixture with the tubes and fins being introduced into the fixture in alternating fashion where the tubes are individual pieces of tubing. Where the heat exchanger is of a serpentine form, the fins are introduced between the adjacent runs and at the sides of the core. Side pieces are placed against the fins at the sides of the core. The parts are held in place by fixtures. Then the fixtures are run through a brazing furnace or the like to unite the components.

A substantial cost in the manufacture of such heat exchangers is setting up the headers, tubes, fins and side pieces in the fixtures. Considerable expense in fabrication could be avoided where the components themselves are self-fixturing, allowing the use of separate fixtures to be done away with.

One type of self-fixturing heat exchanger of this general sort is disclosed in commonly assigned application Ser. No. 09/778,310, filed Feb. 7, 2001, entitled "Heat Exchanger" in the name of Stephen Memory et al. The entire disclosure of the Memory et al. application is herein incorporated by reference. It discloses a self-fixturing heat exchanger but does not deal with the issue of side pieces. Consequently, protection for ends of the fins that extend beyond the first and last tube runs and the rigidifying effect that accompanies side pieces are not present.

The present invention is directed to provide a new and improved, self-fixturing side piece for use in heat exchangers such as, but not limited to, those disclosed in the Memory et al. application.

SUMMARY OF THE INVENTION

It is the principal object of the invention to provide a new and improved side piece construction for heat exchangers. More specifically, it is an object of the invention to provide a new and improved heat exchanger with a self-fixturing side piece.

An exemplary embodiment of the invention achieves the foregoing objects in a heat exchanger that includes a core having at least one row of a plurality of spaced, parallel, straight runs of flattened tubing including spaced first and last runs and each defining an associated side on opposite sides of said row, fins bridging the spacing between each of the plurality of runs and extending outwardly oppositely from outwardly facing sides of the first and last runs and bonded to the tubing, and a side piece at at least one side of the row and sandwiching the fins thereat against one of the first and last runs. The invention includes the improvement wherein the side piece has a length sufficient to extend substantially between the ends of the at least one of the first or last tube runs and inturned ends hooked over the one run at its ends.

In a preferred embodiment, the side piece is brazed to the one run and to at least some of the fins between the side piece and the one run to provide rigidity to the heat exchanger.

In a highly preferred embodiment, there are a pair of the side pieces, one at each side of the row.

A preferred embodiment of the invention contemplates that the inwardly directed ends of the side pieces include notches having a width just slightly larger than the minor dimension of the first and last runs at its respective ends.

In one embodiment, the tube runs, the fins, and the side pieces are aluminum and are bonded together by brazing.

One embodiment of the invention contemplates that the runs be defined by straight lengths of a serpentine formed piece of tubing.

In another embodiment, the runs are defined by individual lengths of straight tubing.

In one embodiment of the invention, the fins are serpentine fins.

In another embodiment of the invention the fins are plate fins.

Other objects and advantages will become apparent from the following specification taken in connection with the accompanying drawings.

DESCRIPTION OF THE PREFERRED EMBODIMENTS

Figure 1:
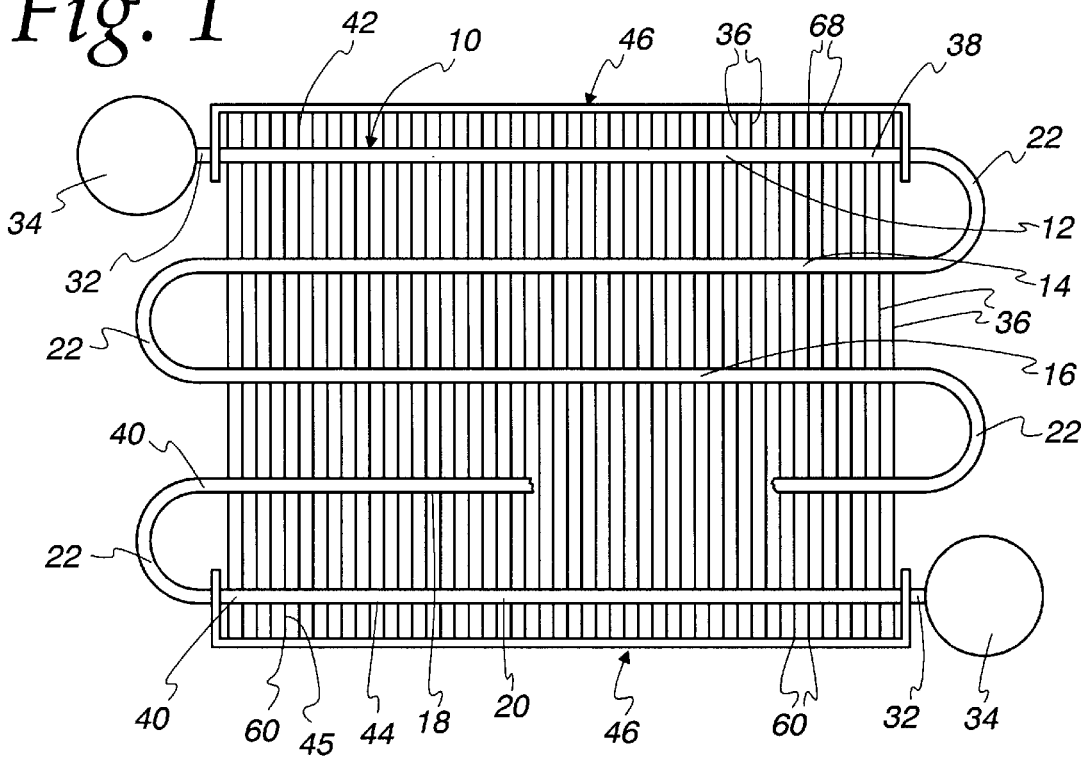
FIG. 1 is an elevation of a serpentine heat exchanger with plate fins and embodying the side pieces of the invention.

Exemplary embodiments of the invention are illustrated in the drawings and in general, will be made up of at least one piece of flattened tubing, plate or serpentine fins, and side pieces made according to the invention. Headers are located on opposite ends of the piece or pieces of tubing.

Preferably, the components are made of aluminum for ease of brazing and light weight although other materials could be used. Further, the components could be bonded together by other means as, for example, soldering. No limitation to any of the above is intended except insofar as stated in the appended claims.

Referring to FIG. 1, one embodiment of the invention is a serpentine heat exchanger having a single piece of flattened tubing, generally designated 10, configured in a serpentine fashion. That is to say, the same will have a plurality of straight runs 12, 14, 16, 18, 20 of the tubing 10. The straight runs 12, 14, 16, 18 and 20 are interconnected by 180° bends 22 which have a sufficient radius as to prevent kinking of the tubing 10. The result will be that the runs are parallel and spaced from another.

Figure 2:
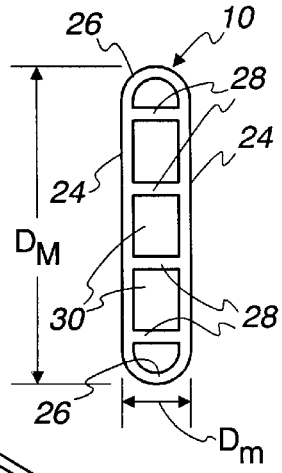
FIG. 2 is a sectional view of a typical piece of flattened tubing utilized in the invention.

FIG. 2 illustrates a typical cross section of the tubing 10. The same has flat outer side walls 24, the distance between which define the minor dimension $D_m$. The flat side walls are connected by rounds 26 which define the major dimension $D_M$. The tube may or may not include interior webs 28. For high pressure applications, the webs 28 will normally be present whereas for low pressure applications, the webs 28 may be dispensed with. Where high performance is involved, the webs 28 will be present to define individual ports 30, each of which will have a hydraulic diameter of 0.07" or less.

Returning to FIG. 1, the ends 32 of the tubing 10 are provided with headers 34 in a conventional fashion. Each of the headers 34 will have an inlet or an outlet port of conventional construction.

In the embodiment illustrated in FIG. 1, plate fins 36, such as those employed in the previously identified application of Memory et al. are provided. The plate fins extend from the right-hand ends 38 (as viewed in FIG. 1) to the left-hand ends 40 of the straight runs 12, 14, 16, 18 and 20. That is to say, the fins 36 extend from one side of the heat exchanger to the other, substantially between the ends 38, 40 of the straight runs 12, 14, 16, 18 and 20 or the headers 34 where present.

Figure 3:
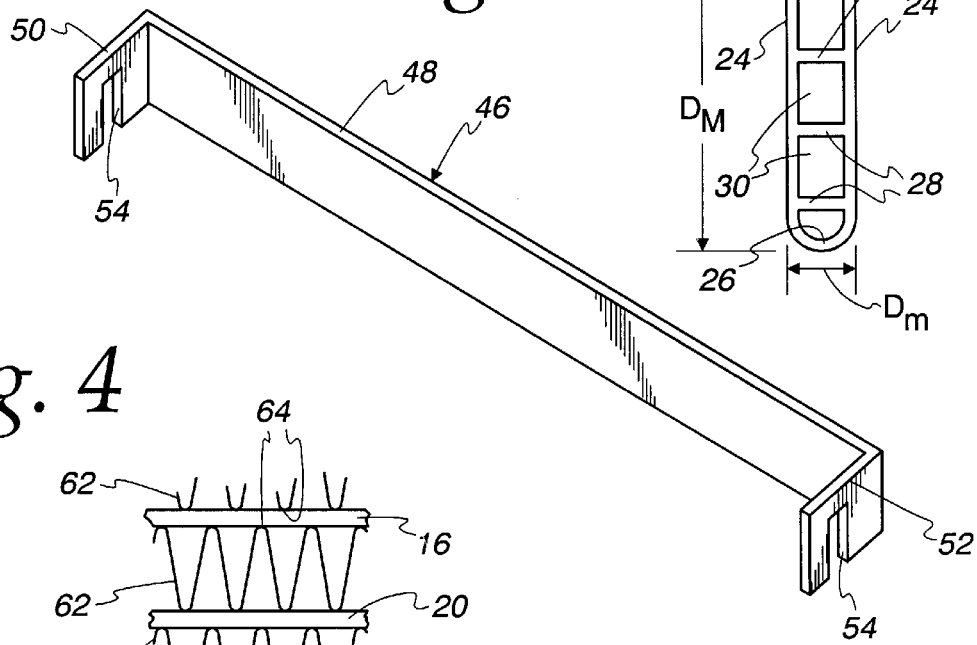
FIG. 3 is a perspective view of a side piece made according to the invention.

It will be particularly observed that on the outwardly facing side 42 of the run 12 and the outwardly facing side 44 of the run 20, which runs constitute the first and last runs in a row of the runs 12, 14, 16, 18 and 20 making up the core of the heat exchanger face oppositely and outwardly from each other. The fins 36 have ends 45 that extend from such sides 42, 44 to engage an associated side piece, generally designated 46, made according to the invention. As seen in FIG. 3, each side piece includes an elongated central section 48 having inturned ends 50 and 52. The length of the central section 48 is such that it extends between the ends 38, 40 of the straight runs 12, 14, 16, 18, 20. Though FIG. 3 illustrates the inturned ends 50 and 52 as being at right angles to the central section 48, other angles may be utilized.

Each of the inturned ends 50 and 52 includes an open ended notch 54. Each notch has a width that is about that of the minor dimension $D_m$. The inturned ends, and specifically the notches 54 thereon, are hooked over the runs 12 and 20, that is, the first and last runs, at their ends 38, 40 so that they substantially engage the ends 45 of each of the fins 36 and sandwich that part of the fin 46 that extends beyond the side 42 or 44, as the case may be against the corresponding run 12 or 20. Braze metal is located where desired, so that the components may be brazed together. Typically, the braze metal may be on the tubing 10 although, if desired, it could be located on the end pieces 42 and the fins 36 as well as the headers 34.

As a result of a brazing operation, the end pieces 46 will be brazed to a corresponding one of the runs 12 or 20 as well as to the ends 45 of the fins 36. In this connection, it may not be possible, due to tolerances, to achieve sufficiently close proximity of all of the central section 48 of the side pieces 46 to the ends 45 of all of the fins 36 and at such locations, brazing will not occur. However, contact will be made in most instances, resulting the central section 48 of each side piece 46 being brazed to the ends 45 of the fins 36 at their tips 60.

Thus, the side pieces 46 will provide their normal function of protecting the ends 45 of the fins 36 from damaging or deforming contact during manufacture or installation. In addition, because they are bonded by brazing to the tips 60 of the fins 36, an added measure of rigidity is introduced into the resulting heat exchanger.

Figure 4:
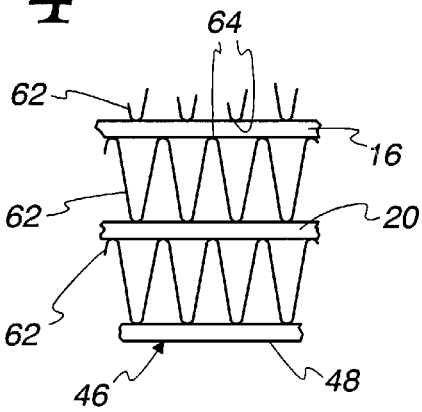
FIG. 4 is a fragmentary elevation of a heat exchanger made according to the invention and embodying serpentine fins.

The invention may also be employed where serpentine fins 62 are utilized rather than the plate fins 36. In this case, crests 64 of the serpentine fins 62 will bond to the tube runs 16, 20 as well as to the central section 48 of the side piece 46. Such a construction is illustrated in FIG. 4, for example.

Figure 5:
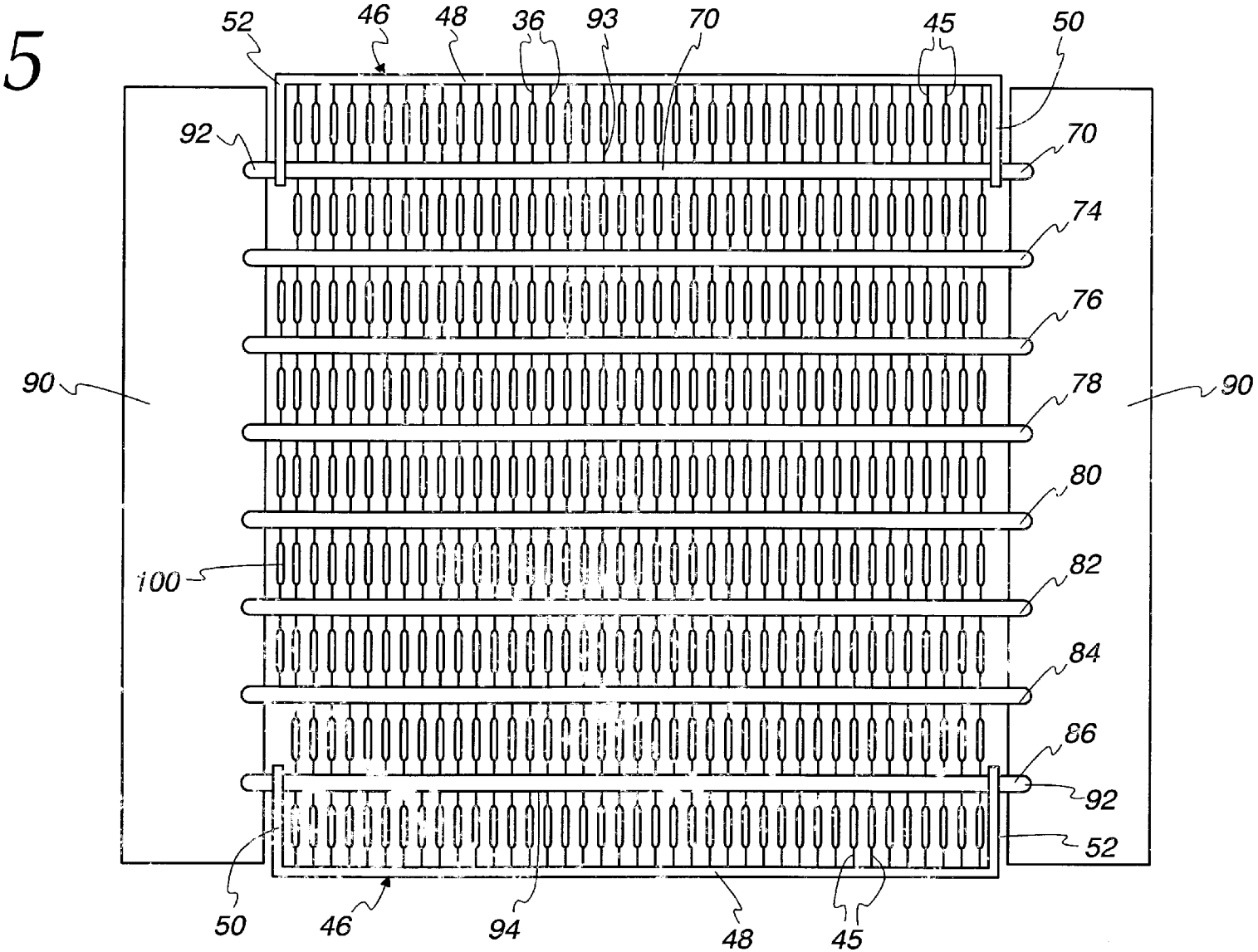
FIG. 5 is an elevation of a parallel flow heat exchanger with plate fins and embodying side pieces according to the invention.

Moreover, the invention is not limited to use with serpentine condensers. FIG. 5 illustrates a so-called parallel flow condenser wherein tube runs 70, 74, 76, 78, 80, 82, 84 and 86 extend between headers 90 and are in fluid communication with the interior thereof by means of slots 92 in each of the headers 90 which are aligned with one another. In the embodiment illustrated in FIG. 5, plate fins 36, again of the type disclosed in the above-identified Memory et al. application, are employed. The tubes 70 are made up of individual pieces of straight tubing and are parallel and spaced as illustrated. Again, the first run 70 and the last run 86 have flat surfaces 94 which face away from one another and outwardly. Ends 45 of the fins 36 again extend outwardly and away from the surfaces 93, 94 of the first and last tube runs 70, 92. The central section 48 of each of the side pieces 46 sandwiches the fin ends 45 against the surface 93, 94, as the case may be, of the first and last runs 90 and 92. The side pieces 46 may have the same configuration as described previously and as illustrated in FIG. 3 and are hooked over the first and last tube runs 70, 92 in the same fashion. Dimensional relationships are the same. As illustrated on the right-hand side of FIG. 5, an end most one of the plate fins 36 has been entirely removed to provide a securing area so that the inturned end 50 of the upper side piece 46 and the inturned end 52 of the lower side piece 46 may be hooked over the first and last tube runs 70, 92 at their ends. If desired, in some instances, a shorter plate fin such as shown at 100 on the left-hand side of FIG. 5 may be utilized to add exterior surface to the heat exchanger while still providing room for the inturned ends 52, 50 of the first and last tube runs 70, 92 respectively. Again, the central sections 48 of the side pieces 46 will braze to at least some of the fin ends 45 to provide structural rigidity and a measure of protection for those ends.

It will be appreciated from the foregoing description that, by means of the snug fit achieved between the end pieces 48 and the corresponding first and last runs of the tubing, the side pieces 46 are self-fixturing. That is to say, they do not require the presence of a fixture to hold them in place during an assembly operation such as brazing. Consequently, side piece holding fixtures may be eliminated, thereby eliminating equipment required in the assembly operation as well as the time spent by an assembler in placing the fixtures on the heat exchanger. As a result, heat exchangers employing the invention may be manufactured more economically than heat exchangers heretofore known.

I claim:

1. In a heat exchanger including a core having at least one row of a plurality of spaced, parallel, straight runs of flattened tubing having long sides connected by short sides, including first and last spaced side runs, and each defining an associated side on opposite sides of said row; fins bridging the spacing between each of the plurality of runs and extending outwardly oppositely from outwardly facing sides of said first and last runs, and bonded to the tubing; and a pair of side pieces, one at each side of said row and outwardly of the fins thereat, the improvement wherein each said side piece is elongated to extend substantially between the ends of said first and said last runs and sandwiches said fins against said first and last runs, each said side piece including an inwardly directed end hooked on the long sides of the associated one of said first and last runs at said ends thereof.

2. The heat exchanger of claim 1 wherein each said inwardly directed end includes a notch having a width about that of a minor dimension of said first and last run at its respective end, and each said end piece is bonded to the tube defining the run on which it is hooked and to at least some of the fins sandwiched between each side piece and the corresponding one of said first and last runs.

3. The heat exchanger of claim 2 wherein said tube runs, said fins and said side pieces are aluminum and are bonded together by brazing.

4. The heat exchanger of claim 1 wherein said runs are defined by straight lengths of a serpentine formed piece of tubing.

5. The heat exchanger of claim 1 wherein said runs are defined by individual lengths of straight tubing.

6. The heat exchanger of claim 1 wherein said fins are serpentine fins.

7. The heat exchanger of claim 1 wherein said fins are plate fins.

8. In a heat exchanger including a core having at least one row of a plurality of spaced, parallel, straight runs of flattened tubing having long sides interconnected by short sides, including first and last spaced side runs, and each defining an associated side on opposite sides of said row; fins bridging the spacing between each of the plurality of runs and extending outwardly oppositely from outwardly facing sides of said first and last runs, and bonded to the tubing, a side piece at at least one side of said row and sandwiching the fins thereat against one of said first and last runs, the improvement wherein said side piece having a length sufficient to extend substantially between the end of said one run and inturned ends having notches hooked over said long sides of said one run at said ends of said one run.

9. In a heat exchanger including a core having at least one row of a plurality of spaced, parallel, straight runs of flattened tubing having long sides interconnected by short sides, including first and last spaced side runs, and each defining an associated side on opposite sides of said row; fins bridging the spacing between each of the plurality of runs and extending outwardly oppositely from outwardly facing sides of said first and last runs, and bonded to the tubing, a side piece at least one side of said row and sandwiching the fins thereat against one of said first and last runs the improvement wherein said side piece has a length sufficient to extend substantially between the end of said one run and inturned ends each provided with a transverse notch having a width just greater than said short sides, said notches being hooked over said one run at said ends of said one run, said side piece being brazed to said one run and to at least some of the fins between said side piece and said one run.

10. The heat exchanger of claim 7 wherein said runs are straight lengths of a piece of serpentine formed tubing and said fins are plate fins extending the length of said row.

11. The heat exchanger of claim 9 wherein said inturned ends include open ended notches fitted over and snugly receiving said ends of said first and last runs.

* * * * *